US006624346B2

(12) United States Patent
Standish

(10) Patent No.: US 6,624,346 B2
(45) Date of Patent: Sep. 23, 2003

(54) SUPPORT CUSHION FOR MUSICAL INSTRUMENT

(76) Inventor: Baird Standish, 525 Cresheim Valley Rd., Wyndmoor, PA (US) 19038

( * ) Notice: Subject to any disclaimer, the term of this patent is extended or adjusted under 35 U.S.C. 154(b) by 0 days.

(21) Appl. No.: 09/942,410

(22) Filed: Aug. 29, 2001

(65) Prior Publication Data

US 2003/0041718 A1 Mar. 6, 2003

(51) Int. Cl.[7] ..... G10D 1/02
(52) U.S. Cl. ..... 84/280; 84/281; 84/327
(58) Field of Search ..... 84/280, 281, 327

(56) References Cited

U.S. PATENT DOCUMENTS 3,979,993 A * 9/1976 Proctor ..... 84/327
4,339,981 A 7/1982 Smith
4,858,801 A * 8/1989 Sameniego ..... 224/258
5,069,103 A * 12/1991 Healy ..... 84/327
5,377,573 A 1/1995 Tretick
6,031,167 A 2/2000 Gaston
6,040,509 A 3/2000 Fanella
6,054,642 A 4/2000 Brooks
6,189,158 B1 2/2001 Lehoux
6,359,203 B1 * 3/2002 Cronos ..... 84/280

* cited by examiner

*Primary Examiner*—Kimberly Lockett
(74) *Attorney, Agent, or Firm*—Duane Morris LLP

(57) ABSTRACT

A playing support device for positioning and supporting a pluck musical instrument such as a guitar in a way which allows the performer to position the instrument in front of the body in a manner as if the instrument were being played in a sitting down position. The playing support device also assists in relieving pull on the shoulder caused by the support strap due to the weight of the instrument. The playing support device includes a cushion attachable to the instrument by adjustable straps which enable a comfortable placement of the cushion between the rear surface of the body of the instrument and the body of the player in the playing position.

8 Claims, 4 Drawing Sheets

SUPPORT CUSHION FOR MUSICAL INSTRUMENT

BACKGROUND OF THE INVENTION

The present invention relates to musical instruments such as guitars, banjos and the like, and more particularly to apparatus for assisting placement and retention of the instrument in a comfortable playing position.

Guitars, both acoustic and electric, are often played from a standing position with the instrument being supported by a strap looped over the shoulder of the player. While a standing position facilitates the ability to move about on a stage and to perform easily in front of an audience and with other performers, the standing position does not adequately allow the performer to play in a position that is both comfortable and allows the performer the full range of motion, optimum accessibility by both hands to the instrument, and adequate sight lines to the instrument. This is particularly the case with an acoustic instrument, which is typically deeper and less contoured, if at all, on the back than it'electric counterpart, although the same principal applies in both cases. Playing an instrument in a standing position necessitates that the front of the instrument face completely away from the performer, with the back of the instrument flush with the performer's torso. Also, the weight of the guitar can become quite uncomfortable for the player after playing the guitar in a standing position over a period of time. The traditional support strap can also cause tension on the neck due to the weight of the instrument.

Historically, guitars and other similar stringed instruments were designed to be played, and are played, in a sitting down position. This position allows a performer to both tilt the guitar at an angle so that the bottom back edge of the instrument rests on either knee, the top back edge of the instrument only is touching the torso, and a gap is formed between the instrument and the torso. An imaginary line parallel to the face of the instrument and running between the ceiling and the floor thus intersects an imaginary line parallel to the performer's upright torso. This allows better right hand access to the strings in the vicinity of the sound hole by the right hand, with less strain put on the right wrist because of the angle, and the further ability to hold the forearm off the face of the instrument, thus allowing the instrument to reverberate naturally. The performer also has the ability thus to tilt the neck of the instrument toward the ceiling for better left hand accessibility, and to angle the top leading edge of the neck toward the performer's torso in order to facilitate comfort and maximize the performer's sight lines to the entire neck in addition to the face of the guitar.

Another problem sometimes encountered when using a traditional support strap involves damage caused to the rear surface of the instrument by the player's belt buckle. Using the traditional support strap, the rear surface of the instrument contacts the player's torso as described above. Such contact can result in scratching of the rear surface by a belt buckle or other hard objects, such as jewelry, worn in the front of the player's torso.

SUMMARY OF THE INVENTION

The present invention comprises a playing support device for positioning and supporting a plucked musical instrument such as a guitar or the like, in a way which allows the performer to position the instrument in front of the body in a manner as if the instrument were being played in a sitting down position as described above. This device also assists in relieving pull on the shoulder caused by the support strap due to the weight of the instrument. The instrument includes a body portion having a rear surface and a neck portion connected to a second end of the body portion. A first strap attachment button is attached to a first end of the body portion opposite the second end. Some guitars have a second strap attachment button which is attached to the instrument proximate the region where the neck portion joins the body portion. The playing support device of the present invention is useable with both types. The playing support device comprises a cushion member; a first adjustable strap member having opposite ends, one end being attachable to a first end of the cushion member; and a second adjustable strap member having opposite ends, one end being attachable to a second end of the cushion member. In one embodiment of the present invention, useable with those instruments having first and second strap attachment buttons, the other end of the first adjustable strap member is attachable to the first strap attachment button; and the other end of the second adjustable strap member is attachable to the second strap attachment button. In another embodiment of the invention, useable with those guitars having no second strap attachment button, an auxiliary adjustable support member is useable in place of the second adjustable strap member. In this embodiment, one end of the auxiliary adjustable support member is attachable to the second end of the cushion. The other end of the auxiliary adjustable support member is attachable to a portion of a guitar support strap attached to the guitar. In yet another embodiment of the invention, both adjustable strap members encircle the waist of the player with the other ends of the adjustable strap members attached together to secure the cushion member in position between the body of the player and the rear surface of the body of the instrument.

DETAILED DESCRIPTION

Figure 1:
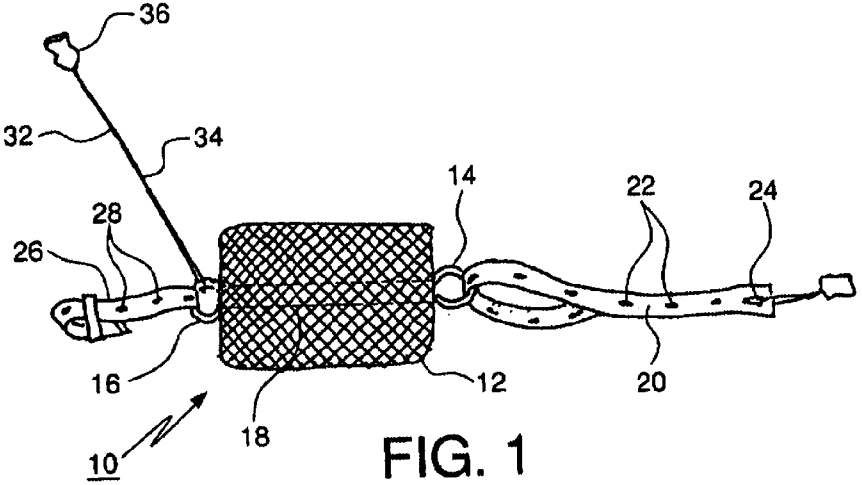
FIG. 1 is a front view of an instrument playing support device in accordance with the present invention.

Referring to FIG. 1, there is shown a front view of an instrument playing support device in accordance with the present invention, generally designated 10. The instrument playing support device 10 comprises a cushion member 12 having a first attachment ring 14 attached to a first end of the cushion member 12 and a second attachment ring 16 attached to a second end of the cushion member 12. The cushion member 12 is preferably oval shaped approximately 8" by 8" in size. It should be noted that other shapes and sizes may be suitable and such are considered to be within the scope of the present invention. The cushion member 12 has a cover preferably constructed of velveteen, non-ridged corduroy, ultrasuede or similar non-abrasive material, filled with cotton, wool, kapok, husks or similar stuffing. The cover preferably has a pleated opening 13 (see FIG. 2) for adding or removing stuffing material. The lip of the pleated opening is folded down to provide a small pocket for accessories such as guitar picks.

The first 14 and second 16 attachment rings are preferably constructed of brass or hard plastic. In the preferred embodiment, the first 14 and second 16 attachment rings are connected by a heavy ribbon, leather or fabric connection member 18 running through the cushion member 12. A first adjustable strap member 20 is attached to the first end of the cushion member 12 through the first attachment ring 14. The first adjustable strap member 20 is preferably a composite nylon Velcro® and leather strap one inch in width. The first end of the first adjustable strap member 20 is looped through the first attachment ring 14 with the end of the strap secured to an intermediate portion of the strap by a Velcro® fastener. The other, second end of the first adjustable strap member 20 has an aperture 24 therein for attaching to a strap attachment button on the instrument to be played.

Figure 2:
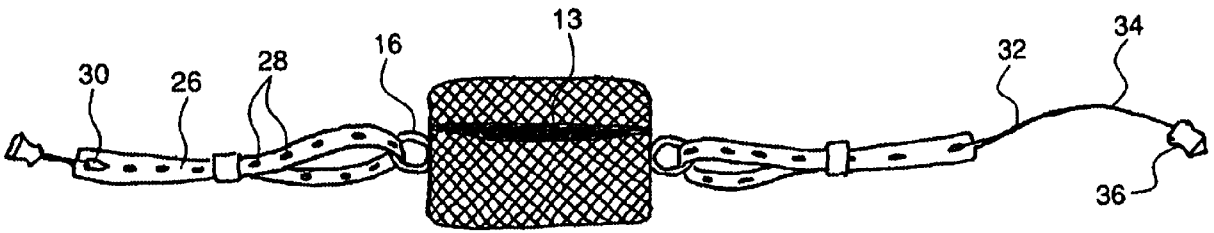
FIG. 2 is a rear view of the playing support device of the present invention depicted in FIG. 1.

Referring to FIG. 2, a second adjustable strap member 26 is attached to the second end of the cushion member 12 through the second attachment ring 16. The second adjustable strap member 26 is preferably of the same construction as the first adjustable strap member 20. The first end of the second adjustable strap member 26 is looped through the second attachment ring 16 with the end of the strap secured to an intermediate portion of the strap by a Velcro® fastener. The other, second end of the second adjustable strap member 26 has an aperture 30 therein for attaching to a strap attachment button on the instrument to be played.

An auxiliary adjustable strap member 32 is attachable to the second attachment ring 16 for use with instruments having only one strap attachment button as will be hereinafter described. The auxiliary adjustable strap member 32 comprises a flexible cord 34 having a clip 36 at one end thereof. The instrument playing support device 10 is configured as shown in FIG. 1 when used with instruments having only one strap attachment button. In this configuration, the cord 34 is looped through the second attachment ring 16 with the end of the cord 34 secured by a half hitch made in the cord. The other end of the auxiliary adjustable support member is attachable to a portion of a guitar support strap attached to the guitar as will be described later. The second adjustable strap member 26 is stowed preferability by folding it back on itself as shown in FIG. 1 or may be removed entirely. When used with instruments having two strap attachment buttons, the instrument playing support device 10 is preferably configured as shown in FIG. 2 with the auxiliary adjustable strap member 32 removed.

Figure 4:
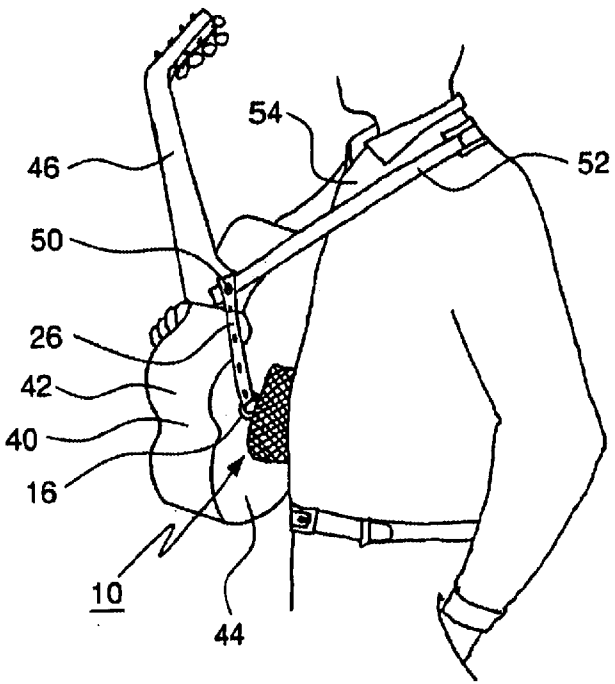
FIG. 4 depicts a portion of the playing support device of the present invention showing an end of a second adjustable strap member attached to the second strap attachment button on the body of the guitar proximate the region where the neck portion joins the body portion of the instrument.
Figure 3:
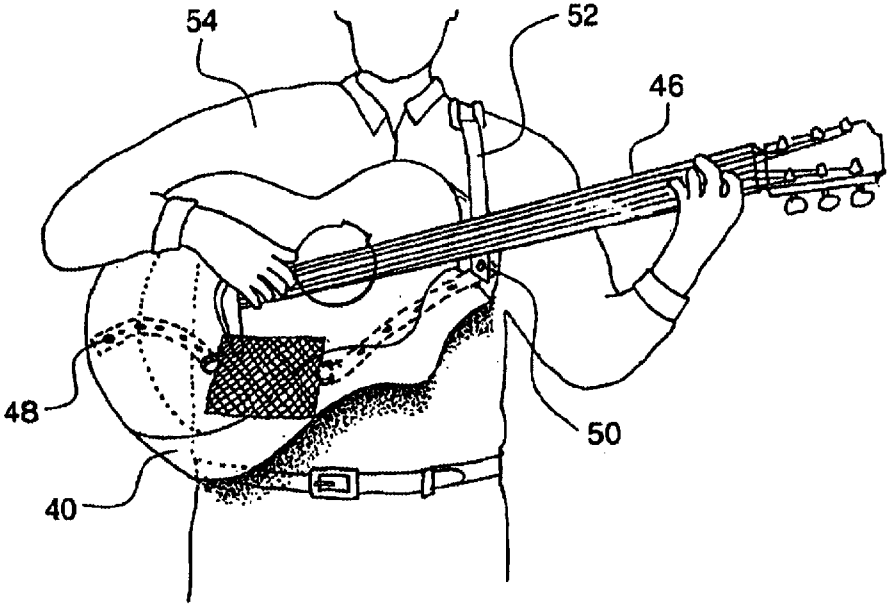
FIG. 3 depicts, in partial phantom view, the playing support device in accordance with the present invention attached to first and second strap attachment buttons on a guitar.

Referring now to FIGS. 3 and 4, there is shown the instrument playing support device 10 being used in connection with a guitar 40 including a body portion 42 having a rear surface 44 and a neck portion 46 connected to a second end of the body portion 42. A first strap attachment button 48 is attached to a first end of the body portion opposite the second end. A second strap attachment button 50 is attached to the guitar proximate the region where the neck portion 46 joins the body portion 42. A guitar strap 52 is connected between the first 48 and second 50 strap attachment buttons and looped over the shoulder of the player 54 in the playing position. The instrument playing support device 10 is attached to the guitar 40 by inserting the first strap attachment button 48 through the aperture 24 located at the end of the first adjustable strap 20, and inserting the second strap attachment button 50 through the aperture 30 located at the end of the second adjustable strap 26. The first 20 and/or second 26 straps are adjusted as required to provide a comfortable placement of the cushion member 12 between the rear surface 44 of the body 42 of the instrument 40 and the body of the player 54 in the playing position.

Figure 5:
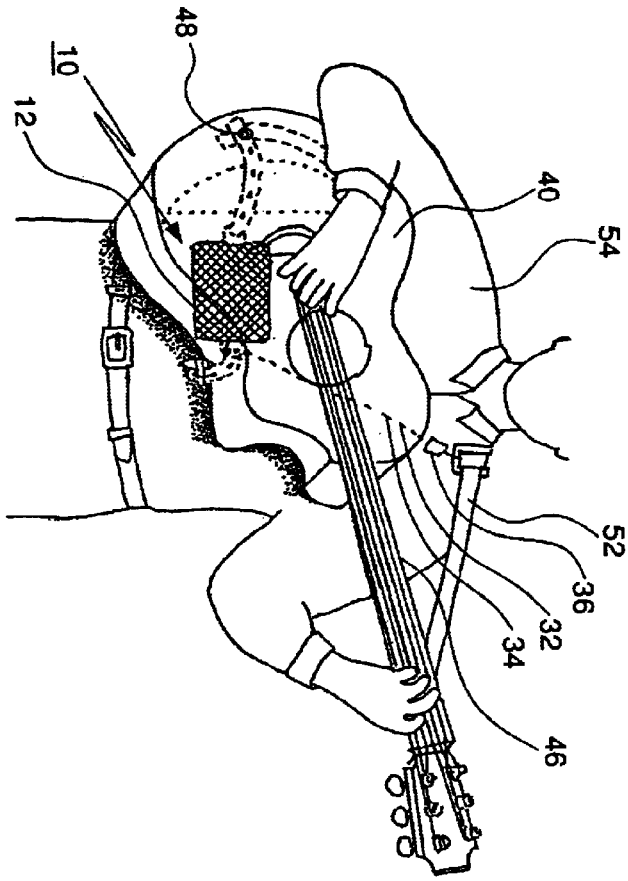
FIG. 5 depicts, in partial phantom view, another embodiment of the playing support device in accordance with the present invention with the first adjustable strap member attached between the first end of the cushion and the first strap attachment button as depicted in FIG. 3, and an auxiliary adjustable support member attached between the second end of the cushion and a portion of a guitar support strap.
Figure 6:
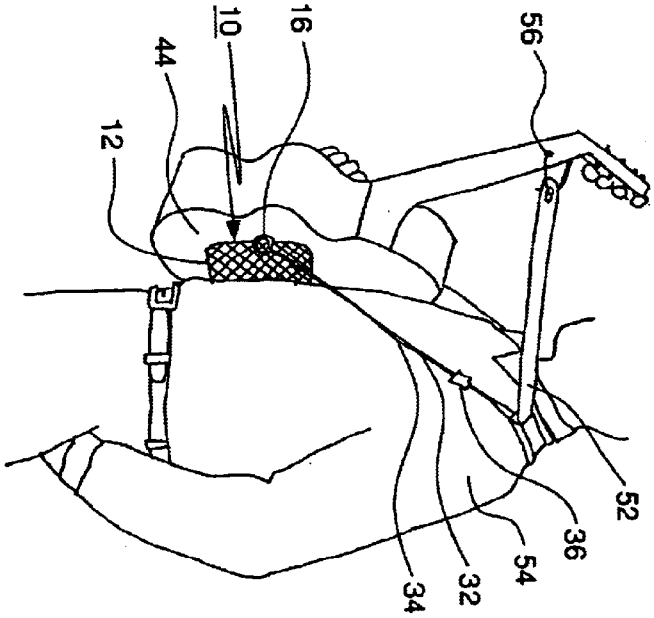
FIG. 6 depicts a portion of the embodiment of playing support device of the present invention depicted in FIG. 5 showing an end of the auxiliary adjustable support member attached between the second end of the cushion and a portion of a guitar support strap.

Referring now to FIGS. 5 and 6, there is shown the instrument playing support device 10 being used in connection with a guitar 40 including a body portion 42 having a rear surface 44 and a neck portion 46 connected to a second end of the body portion 42. A first strap attachment button 48 is attached to a first end of the body portion opposite the second end. The guitar depicted in FIGS. 5 and 6 has no second strap attachment button attached to the guitar proximate the region where the neck portion 46 joins the body portion 42. With the guitar 40 depicted in FIGS. 5 and 6, the guitar strap 52 is connected between the first strap attachment button 48 and an attachment point 56 located on the neck portion 46 proximate the tuning knobs 58. The guitar strap 52 thus attached to the guitar 40 is looped over the shoulder of the player 54 in the playing position. The instrument playing support device 10 is attached to the guitar 40 by inserting the first strap attachment button 48 through the aperture 24 located at the end of the first adjustable strap 20. The auxiliary adjustable strap member 32 is attached to the second attachment ring 16 as depicted in FIG. 1 and described above. The end of the auxiliary adjustable strap member 32 is attached to the guitar strap 52 by a half hitch made in the cord. The first adjustable strap 20 and/or the auxiliary adjustable strap member 32 are adjusted as required to provide a comfortable placement of the cushion member 12 between the rear surface 44 of the body 42 of the instrument 40 and the body of the player 54 in the playing position.

Figure 7:
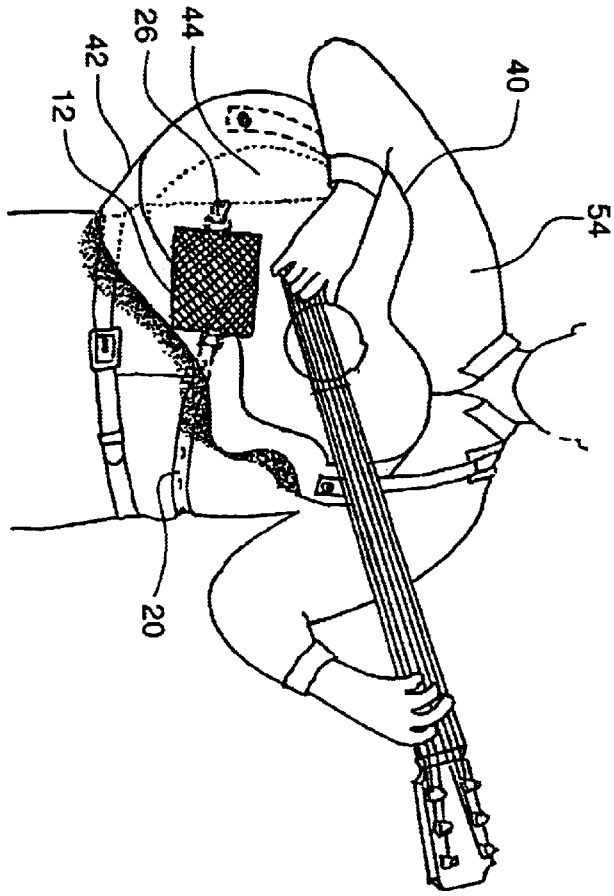
FIG. 7 depicts, in partial phantom view, yet another embodiment of the playing support device in accordance with the present invention in which the other ends of the adjustable strap members attached together to secure the cushion member in position between the body of the player and the rear surface of the body of the instrument.
Figure 8:
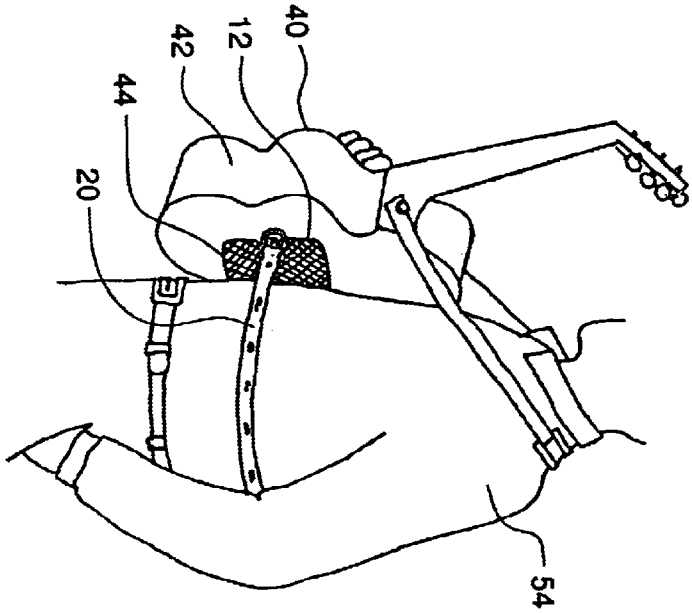
FIG. 8 depicts a portion of the embodiment of the playing support device for the present invention depicted in FIG. 7 showing another view of that embodiment of the present invention in which the other ends of the adjustable strap members are attached together to secure the cushion member in position between the body of the player and the rear surface of the body of the instrument.

Referring now to FIGS. 7 and 8 there is shown the instrument playing support device 10 in accordance with the present invention in which the ends of the first 20 and second 26 adjustable strap members are attached together to secure the cushion member 12 in position between the body of the player 54 and the rear surface 44 of the body 42 of the guitar 40. In this configuration, the first 20 and second 26 adjustable strap members are connected to the cushion member 12 as depicted in FIG. 2 and described above. The first 20 and second 26 adjustable strap members are then wrapped around the body of the player 54 with the ends being attached by clips. The first 20 and/or second 26 straps are adjusted as required to provide a comfortable fit around the body and placement of the cushion member 12 between the rear surface 44 of the body 42 of the instrument 40 and the body of the player 54 in the playing position.

I claim:

1. A playing support device for positioning and supporting a plucked musical instrument such as a guitar in spaced relation with respect to a player's torso, the instrument including a body portion having a rear surface and a neck portion connected to a second end of the body portion and at least a first strap attachment button attached to a first end of the body portion, said playing support device comprising:

(a) a cushion member interposable between the rear surface of said plucked musical instrument and the player's torso; and (b) first and second adjustable strap members for supporting said cushion in a selected position between the rear surface of said plucked musical instrument and the player's torso, said first adjustable strap member having opposite ends, one end being attached to a first end of the cushion member and the other end being attachable to said first strap attachment button; and said second adjustable strap member having opposite ends, one end being attached to a second end of the cushion member and the other end being attachable to a musical instrument supporting member connected to said instrument.

2. A playing support device in accordance with claim 1 wherein said musical instrument supporting member comprises a second strap attachment button.

3. A playing support device in accordance with claim 1 wherein said musical instrument supporting member comprises a guitar strap.

4. A playing support device in accordance with claim 1 wherein said cushion member includes a cover portion fillable with stuffing material.

5. A playing support device in accordance with claim 4 wherein said cushion member additionally comprises an opening in said cover portion for adding or removing stuffing material.

6. A playing support device in accordance with claim 5 wherein said opening is pleated, having a pocket for storing accessories.

7. A playing support device in accordance with claim 1 additionally comprising means for releasably attaching the other end of the first adjustable strap member to the other end of the second adjustable strap member.

8. A playing support device in accordance with claim 7 wherein said means for releasably attaching comprises a first releasable attachment clip attached to the other end of the first adjustable strap member and a second releasable attachment clip, mateable to said first releasable attachment clip, connected to the other end of said second adjustable strap member.

* * * * *